US007650711B2

(12) United States Patent
Robitaille

(10) Patent No.: US 7,650,711 B2
(45) Date of Patent: Jan. 26, 2010

(54) RIFLE SCOPE WITH TEXTURED PROFILE

(75) Inventor: Morris Robert Robitaille, Midland (CA)

(73) Assignee: Raytheon Company, Waltham, MA (US)

( * ) Notice: Subject to any disclaimer, the term of this patent is extended or adjusted under 35 U.S.C. 154(b) by 161 days.

(21) Appl. No.: 11/821,836

(22) Filed: Jun. 26, 2007

(65) Prior Publication Data

US 2009/0000176 A1 Jan. 1, 2009

(51) Int. Cl.
*F41G 1/38* (2006.01)

(52) U.S. Cl. ..... 42/119

(58) Field of Classification Search ..... 42/111, 42/119, 130, 132, 133, 140, 141, 142, 143, 42/144

See application file for complete search history.

(56) References Cited

U.S. PATENT DOCUMENTS 6,321,479 B1 * 11/2001 Sheehan ..... 42/111

* cited by examiner

*Primary Examiner*—Bret Hayes
(74) *Attorney, Agent, or Firm*—H. St. Julian, Esq.

(57) ABSTRACT

A riflescope. In the illustrative embodiment, the inventive riflescope is implemented with a housing having an exterior surface and a texture applied to the surface of the housing. In the best mode, the texture has an elevation of 250 microns above the surface of the housing. In more specific embodiments, the texture is uniform and geometric.

3 Claims, 2 Drawing Sheets

FIG. 3
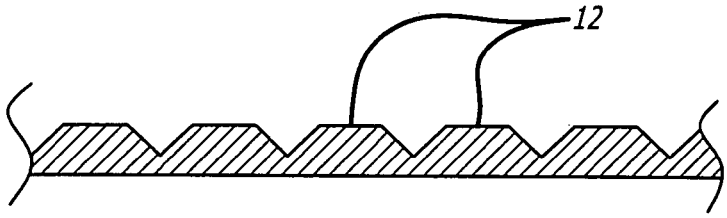
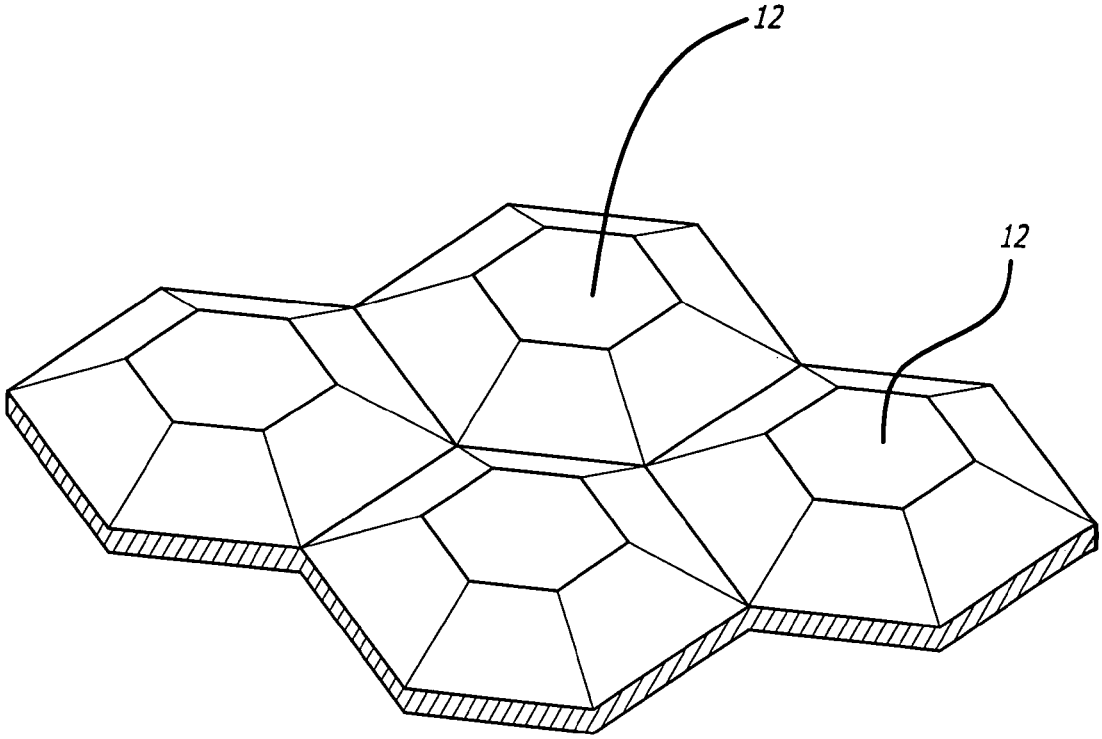
FIG. 4

RIFLE SCOPE WITH TEXTURED PROFILE

BACKGROUND OF THE INVENTION

1. Field of the Invention

The present invention relates to firearms. More specifically, the present invention relates to riflescopes.

2. Description of the Related Art

Telescopes are used on some rifles to improve the long-range accuracy thereof. For certain applications, especially military applications, there is often a need to minimize reflection from the rifle including any 'scope' that may be mounted thereon. Indeed, in military circles, it is well known that a single reflection may reveal a soldier's position and put the soldier and his unit in jeopardy.

Hence, a common practice is to apply a matte or crinkle finish to the scope. A conventional matte finish is less than 20 microns deep and is applied by sandblasting.

Unfortunately, over time, these finishes are often worn off by the rugged environment in which the rifle is transported and used. Consequently, areas of relatively high reflectivity often appear on rifles scopes matted in accordance with conventional teachings.

Accordingly, a need remains in the art for a system or method for minimizing reflections from riflescopes.

SUMMARY OF THE INVENTION

The need in the art is addressed by the riflescope of the present teachings. In the illustrative embodiment, the inventive riflescope is implemented with a housing having an exterior surface and a texture applied to the surface of the housing. In the best mode, the texture has an elevation of 250 microns above the surface of the housing.

In more specific embodiments, the texture is uniform and geometric.

BRIEF DESCRIPTION OF THE DRAWINGS

FIG. 3 is a sectional side view of the portion of the riflescope housing depicted in FIG. 2.

FIG. 4 is a perspective view of a portion of the textured surface of the riflescope of FIG. 1.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
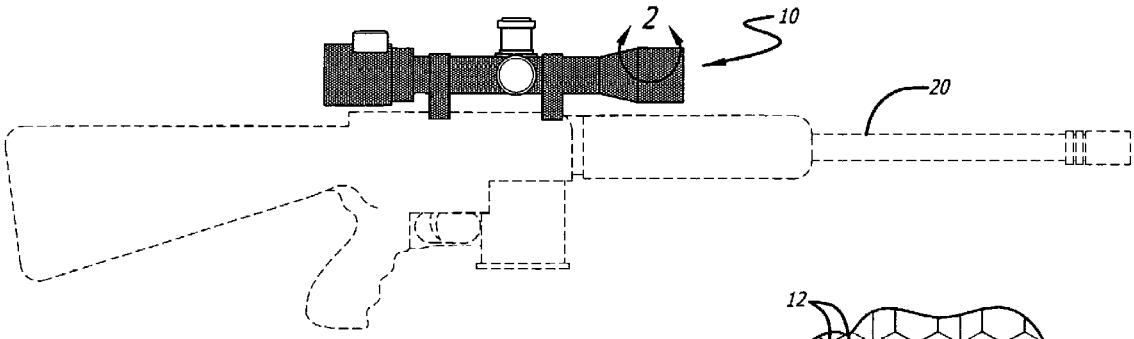
FIG. 1 is an elevated side view of a textured riflescope in accordance with an illustrative embodiment of the present teachings.

FIG. 1 is an elevated side view of a textured riflescope in accordance with an illustrative embodiment of the present teachings. The inventive riflescope 10 is mounted on a rifle 20 (shown in phantom). The riflescope has a cylindrical housing. In the best mode, the scope 10 is constructed of metal. However, the invention is not limited thereto. In accordance with the present teachings, the housing has a textured surface as shown more clearly in FIG. 2.

Figure 2:
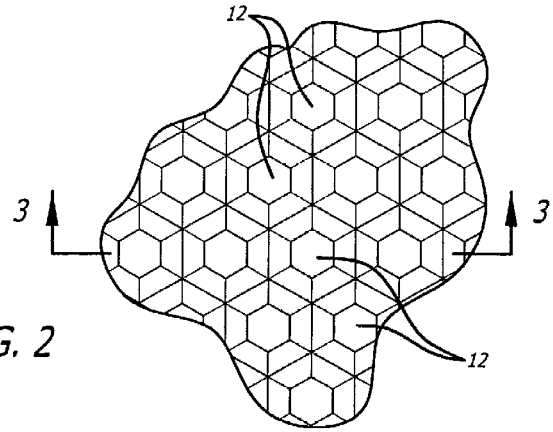
FIG. 2 is a magnified view of the surface of the housing of the riflescope of FIG. 1.

FIG. 2 is a magnified view of the surface of the housing of the riflescope of FIG. 1. As shown in FIG. 2, the surface is textured with a plurality of elevated features 12. In the illustrative embodiment, the texture is created with a die (not shown), investment casting or lost wax process.

FIG. 3 is a sectional side view of the portion of the riflescope housing depicted in FIG. 2. As illustrated in FIG. 3, each feature 12 is a three-dimensional polygon designed to scatter light and thereby minimize reflection therefrom. In the illustrative embodiment, each feature 12 is at least 250 microns above the surface 16 of the riflescope housing.

FIG. 4 is a perspective view of a portion of the textured surface of the riflescope of FIG. 1. The texture may be geometric or irregular without departing from the scope of the present teachings. Those skilled in the art will appreciate that other textures may be used.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A riflescope comprising:

a housing having an exterior surface and a texture applied to said surface of said housing, said texture consisting essentially of a plurality of features, each feature being an elevated three-dimensional polygon designed to scatter light and minimize reflection therefrom, said features having an elevation of approximately 250 microns above said surface.

2. The invention of claim 1 wherein said texture is uniform.

3. The invention of claim 2 wherein said texture is geometric.

* * * * *